US005845427A

United States Patent [19]

Taylor

[11] Patent Number: 5,845,427

[45] Date of Patent: Dec. 8, 1998

[54] ADJUSTABLE GUN REST

[76] Inventor: Jeffrey Taylor, R.D. 1 Box 7B, Mayport, Pa. 16240

[21] Appl. No.: 961,837

[22] Filed: Oct. 31, 1997

[51] Int. Cl.[6] ..... F41C 27/00

[52] U.S. Cl. ..... 42/94

[58] Field of Search ..... 42/94

[56] References Cited

U.S. PATENT DOCUMENTS

| | | | |
|---|---|---|---|
| 1,890,423 | 12/1932 | Teagarden | 42/94 |
| 3,576,084 | 4/1971 | Anderson, Jr. | 42/94 |
| 3,772,813 | 11/1973 | Sands | 42/94 |
| 4,575,964 | 3/1986 | Griffin | 42/94 |
| 4,858,359 | 8/1989 | Danz | 42/94 |
| 5,060,409 | 10/1991 | Caustic | 42/94 |
| 5,311,693 | 5/1994 | Underwood | 42/94 |
| 5,421,115 | 6/1995 | McKay | 42/94 |
| 5,507,111 | 4/1996 | Stinson et al. | 42/94 |
| 5,617,666 | 4/1997 | Scott | 42/94 |

FOREIGN PATENT DOCUMENTS

| | | | |
|---|---|---|---|
| 1185511 | 1/1965 | Germany | 42/94 |

*Primary Examiner*—Harold J. Tudor
*Assistant Examiner*—Denise J. Buckley
*Attorney, Agent, or Firm*—Kenneth P. McKay, Esq.

[57] ABSTRACT

A gun rest which aids the sighting of a gun, particularly a rifle. The gun rest allows the accurate sighting-in of a rifle or assists in long distance shooting. The gun rest accommodates a variety of rifle configurations, and adjusts to the preference of the shooter as to positioning of the gun, horizontally and with respect to elevation and azimuth of the sights. It is compact and can be easily stowed, or carried by the shooter in a pack.

2 Claims, 3 Drawing Sheets

ADJUSTABLE GUN REST

BACKGROUND OF THE INVENTION

1. Field of the Invention

The present invention relates generally to a device which acts as a gun rest and aid to the sighting of a gun, particularly a rifle, by the user, a "shooter". Gun rests are of particular use in the sighting-in of a rifle, i.e., to assist in its gun sight settings. They are also used in the field in hunting game at long-distances. The gun rest of the present invention accommodates a variety of rifle configurations, and adjusts to the preference of the shooter as to positioning of the gun, horizontally, and with respect to elevation and azimuth of the sights. It is compact and can be easily stowed, or carried by the shooter in a pack.

2. Description of the Related Art

The use of a rest for steadying a rifle is well known in the art. Since the invention of the gun, shooters have used a variety of steadying devices, beginning with an upright post, or tree, onto which the shooter would lean his weapon for bracing assistance. While in the prone position (laying horizontally on the ground) a shooter may be assisted merely by the bracing of his arm, formed as a "V" at the elbow. Simple devices like "Y" shaped tree branches may also serve the shooter.

The shooter requires a firm base for sighting. The recoil of a weapon when fired can easily disrupt the sight concentration and require constant readjustment for the shooter. This is not satisfactory for the shooter performing rapid fire shooting.

The elevation (vertical distance from the support to the weapon sight) of the weapon is important. This is affected by the physical size of the shooter and is a matter of bracing, and of comfort.

The azimuth of the front sight is acutely sensitive to the shooter, affecting the line of sight from the shooter's eye, through the rear sight the front sight and upon the target. The horizontal train of the stock is of paramount importance to the shooter in accommodating the weapon into his shoulder for a firm grip.

It is seen, then, that each shooter is individually in need of the ability to adjust each of these parameters to his own physical preference.

Known devices include a vertical pole which is lodged into the ground and allows some adjustment, based on flexibility of the earth. Also known are devices which are portable. There are in use a variety of devices which steady the weapon from the thigh of the shooter or use other body parts as base appendages from which a brace is extended. The art also shows the use of an adjustable rest which relies on cradling of the rifle barrel. Adjustment mechanisms include screw type elevational shafts. There are also known a variety of devices which rely on the cradling of the rifle stock. It is, therefore, known in the prior art the use of gun rests which are portable, adjustable as to elevation, and which are based on the cradling of the rifle stock.

A major drawback of the current art is the lack of rigidity in the support mechanisms. As shooting requires a very exact sighting base, many of the current art devices are not satisfactory in that regard. Many of the current art devices are suitable only for very gross adjustments to be made, resulting in increments which may not be satisfactory for a particular shooter. Most of the current devices service a particular need of the shooter but do not provide the ability to adjust the many parameters to his or her individual preference. Therefore, there is a need which is satisfied by the present invention as shall be described, shown and claimed herein.

PRIOR ART

U.S. Pat. No. 3,576,084 (Anderson) dated Apr. 27, 1971 shows a simple device which allows the rifle forward stock section to be cradled on a vertical pole. The pole is lodged into the ground and allows some adjustment based on flexibility of the earth.

U.S. Pat. No. 4,575,964 (Griffin) of Mar. 18, 1986 shows a more portable device which is levered from the thigh of the shooter, but suspends the weapon much the same as does the Anderson patent, above. It is amenable to use with a hand gun, also.

U.S. Pat. No. 5,421,115 (McKay) dated Jun. 6, 1995 shows the use of an adjustable rest which relies on cradling of the rifle barrel. It is adjustable by a screw type elevational shaft.

U.S. Pat. No. 5,507,111 (Stinson, et al), of Apr. 16, 1996 discloses an A-frame type device which has advantages in portability over the prior art, but relies on the cradling of the rifle stock, much as the remainder of the prior art.

SUMMARY OF THE INVENTION

The objective of the present invention is to provide an adjustable, firmly founded gun rest.

A secondary objective is to provide a gun rest which allows for the simple adjustment of the many parameters required for exact shooting, including elevation, azimuth, and horizontal train, while providing for the physical accommodation and comfort of the shooter.

A third objective is to provide a gun rest which is easily carried and is portable.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended, and that the invention encompasses such alterations and further modifications in the illustrated device, and such further applications of the principles of the invention illustrated herein, as would normally occur to persons skilled in the art to which the invention relates.

Figure 1:
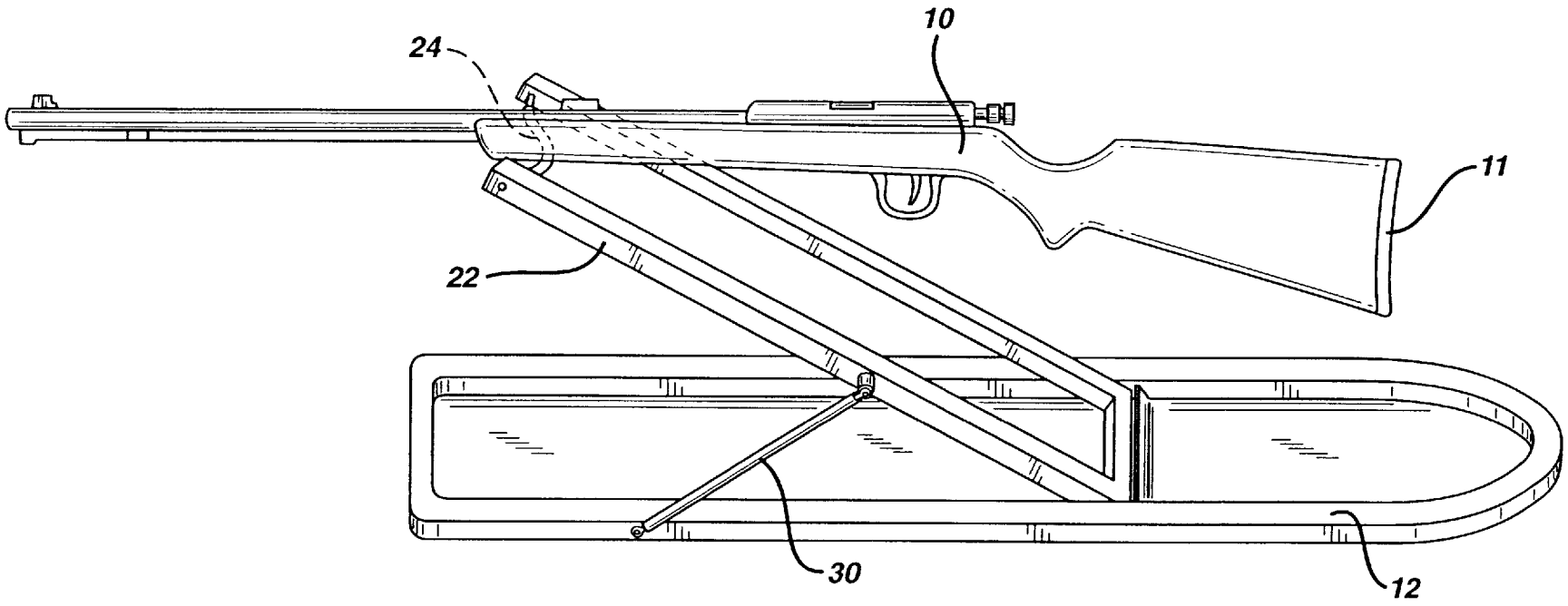
FIG. 1 is a view of the adjustable gun rest in perspective, showing a rifle being aimed utilizing the gun rest.

FIG. 1 demonstrates the adjustable gun rest in operation, with rifle 10 resting in stirrup 24 and being aimed at a target. The elevation of the rifle barrel is adjusted by elevating arm 22. Elevating arm 22 is raised and lowered by elevating mechanism 30. Elevating mechanism 30 is flexibly connected to elevating arm 22 and base 12. Rifle butt 11 rests in the shoulder of the shooter who is then capable of utilizing the gun to site in on a down range target.

Figure 2:
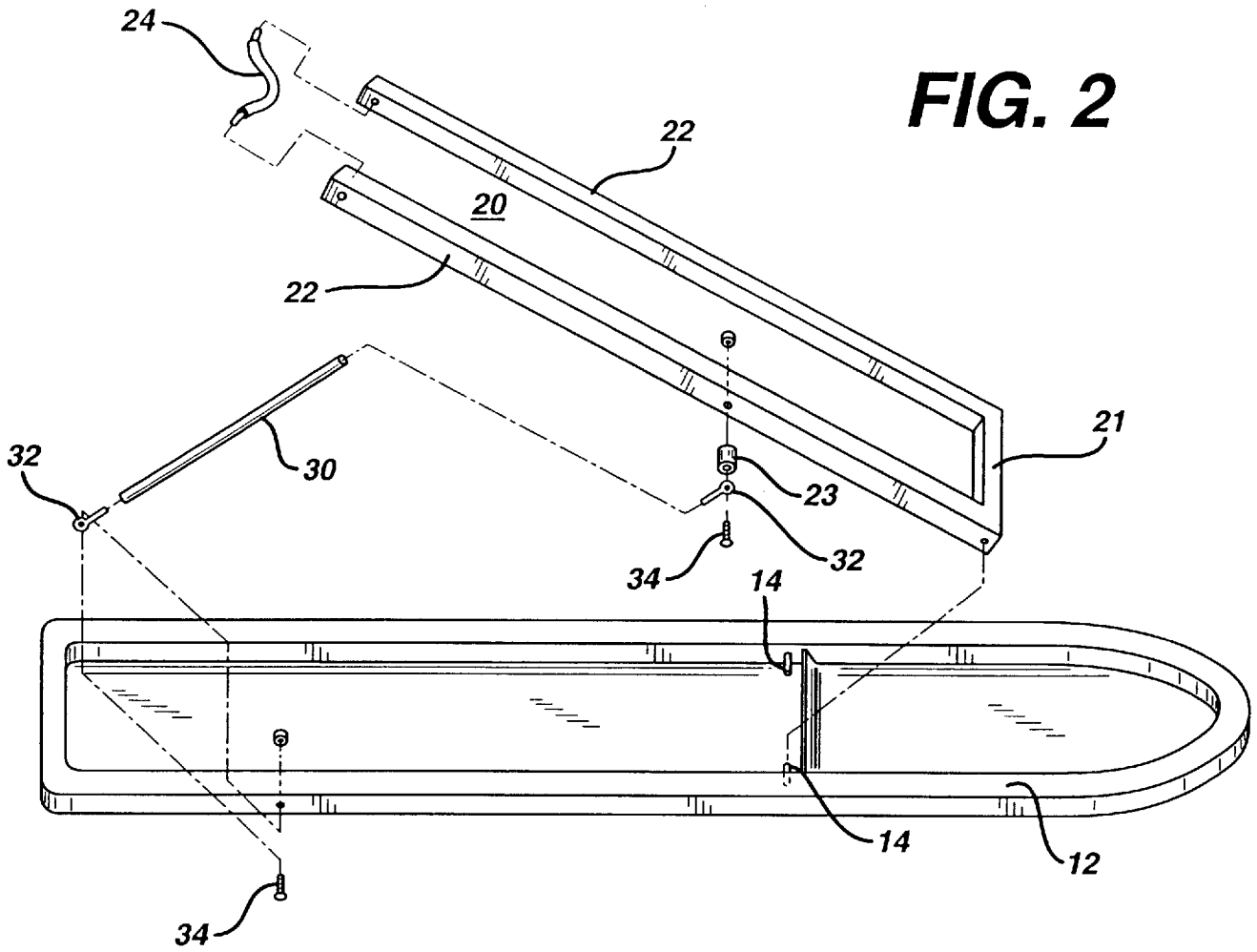
FIG. 2 is an exploded view of the adjustable gun rest showing the major component parts.

FIG. 2. Shows the mechanical connections and operating mechanisms of the adjustable gun rest as follows. Elevating arm 22 is a U-shaped form with butt 21 at the closed end, and stirrup 24 at the open end. Stirrup 24 articulates within two holes formed, one within each leg of the open end of elevating arm 22. Elevating arm 22, at the butt 21 is rotatably connected to base 12 by means of two pins 14 located within the base structure. The butt 21 has formed within its section two holes which rotate about pins 14 as the adjusting mechanism 30 is actuated. Elevating mechanism 30 is comprised of a long rod with threaded cavities at each end into which eye screws 32 are threaded. These allow bolts 34 to be threaded therein and rotatably fastened into both the base 12 and the elevating arm 22 as shown. Because of the narrower width of elevating arm 22 as compared to the base 12, bushing 23 is utilized on the upper elevating mechanism connection point.

Figure 3:
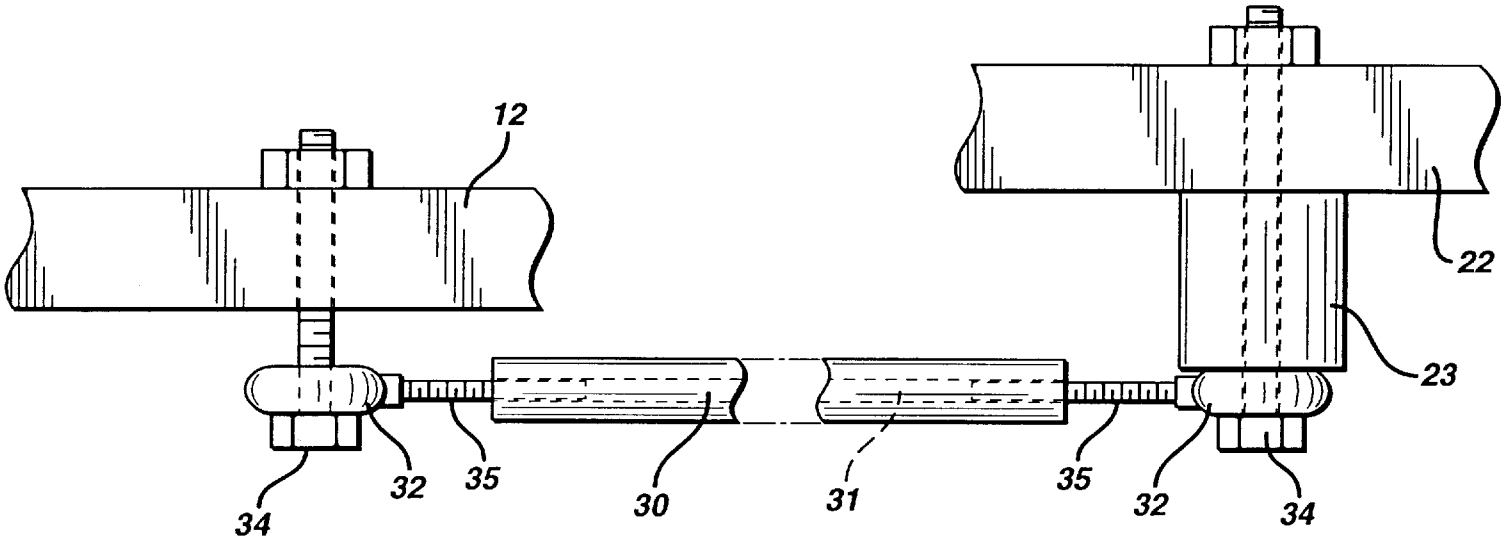
FIG. 3 is a sectional view of the elevation adjusting mechanism for the adjustable gun rest showing the operable parts of the mechanism.

FIG. 3 shows the detailed mechanical connections of elevating mechanism 30 which has cavity 31 which is threaded within its upper and lower structure to accommodate eye screws 35 at each end. The eye screws 35 are thereby connected to each of the upper and lower structures by means of bolts 34 or other means of rotatably fastening the structure such as rivets, screws or cast connections, depending on the means of construction. As can be realized by the study of these drawings, the actuation of elevating mechanism 30 spans the range of stowing the gun rest (with eye screws 35 fully retained within cavity 31) to fully extended (elevating arm 22, in FIG. 2, at its highest point relative to base 12, FIG. 2).

The preferred embodiment may be constructed of a variety of materials, including metals and plastic. Base 12 can be configured in a variety of designs, as may elevating arm 22, any of which facilitate the same function as described herein, without limiting the invention as described and as claimed.

It is claimed:

1. An Adjustable Gun Rest for sighting-in a rifle by a shooter, comprising:

(a) a U-shaped elevating arm having two legs, each of said legs having an inner side and an outer side, said elevating arm thereby formed into a closed end and an open end, and having in each leg at said open end, on said inner side, an opposing hole, and having at said closed end in each leg, on said outer side, a pivot hole, and having, at a distance between said opposing hole and said pivot hole of one of said legs of said elevating arms, an elevating hole on said outer side;

(b) a flattened U-shaped stirrup having two ends, said stirrup rotatably disposed within said open end by suspending each of said ends into a respective opposing hole;

(c) an oval-shaped base having two sides, one of said sides having a mounting hole, said base being disposed between, and rotatably connected to, said pivot hole in said elevating arm such that said mounting hole opposes said elevating hole in said elevating arm; and, (d) a means for elevating said elevating arm with respect to said base, connected to said base at said pivot hole and to said elevating arm at said elevating hole whereby actuation of said elevating means causes said stirrup to move outward with respect to said base thereby accommodating the sighting-in of a rifle by said shooter.

2. An Adjustable Gun Rest for sighting-in a rifle by a shooter, as in claim 1, further comprising a means for elevating said elevating arm with respect to said base, comprising:

(a) a rod having a threaded internal chamber and having two ends;

(b) two eye screws each having a threaded portion and an eye portion, and one each disposed into a respective end of said rod by means of engagement of said threaded portion with said threaded internal chamber; and, (c) two nut and bolt fastening means, one each disposed into a respective eye portion and further disposed such that one of said ends is fixed to said base at said pivot hole and the other of said ends is fixed to said elevating arm at said elevating hole, thereby forming an extended length of said rod constituted by the length of said rod plus the length of said threaded portion and whereby the rotation of said rod further engages said threaded portion of said eye screw varying the extended length of said rod causing said stirrup to move outward with respect to said base thereby accommodating the sighting-in of a rifle by said shooter.

* * * * *